US007140115B2

(12) United States Patent
Greene

(10) Patent No.: US 7,140,115 B2
(45) Date of Patent: Nov. 28, 2006

(54) SHAVING APPARATUS WITH WHEEL

(76) Inventor: Todd M. Greene, 257 Entrada Dr., Los Angeles, CA (US) 90402

( * ) Notice: Subject to any disclaimer, the term of this patent is extended or adjusted under 35 U.S.C. 154(b) by 186 days.

(21) Appl. No.: 10/842,673

(22) Filed: May 10, 2004

(65) Prior Publication Data

US 2005/0246906 A1 Nov. 10, 2005

(51) Int. Cl.
*B26B 21/52* (2006.01)

(52) U.S. Cl. ..... 30/526; 30/537; 30/297; 30/298

(58) Field of Classification Search ..... 30/34.5, 30/541, 334, 85, 537, 34.05, 527, 526, 296.1, 30/297, 298, 34.2
See application file for complete search history.

(56) References Cited

U.S. PATENT DOCUMENTS

| | | | | | |
|---|---|---|---|---|---|
| 2,046,219 | A | * | 6/1936 | Swan | 30/72 |
| 2,716,809 | A | * | 9/1955 | Malone | 30/30 |
| 2,749,613 | A | * | 6/1956 | Vernon | 30/34.2 |
| 4,103,418 | A | | 8/1978 | Alvarez | |
| 4,240,432 | A | * | 12/1980 | Mormann et al. | 606/132 |
| 4,378,633 | A | * | 4/1983 | Jacobson | 30/47 |
| 4,562,644 | A | * | 1/1986 | Hitchens | 30/41 |
| 5,001,832 | A | * | 3/1991 | Althaus | 30/77 |
| 5,134,775 | A | * | 8/1992 | Althaus et al. | 30/41 |
| 5,168,628 | A | * | 12/1992 | Mock et al. | 30/41 |
| 5,267,399 | A | * | 12/1993 | Johnston | 30/41 |
| 5,402,697 | A | * | 4/1995 | Brooks | 83/18 |
| 5,839,198 | A | * | 11/1998 | McCoy | 30/537 |
| 6,018,877 | A | | 2/2000 | Greene | |
| D426,918 | S | | 6/2000 | Greene | |
| 6,112,421 | A | | 9/2000 | Greene | |
| D466,351 | S | | 8/2001 | Greene | |
| 2003/0084573 | A1 | | 5/2003 | Kludjian et al. | |

* cited by examiner

*Primary Examiner*—Timothy V. Eley
*Assistant Examiner*—Omar Flores Sanchez
(74) *Attorney, Agent, or Firm*—Joseph G. Swan

(57) ABSTRACT

Provided are shavers that are particularly applicable to shaving a user's head, but that may be utilized for shaving any part of the body. More specifically, a shaver according to the present invention has one or more of the following elements: a wheel or other rolling device on the same side of the shaver as the razor blade or other shaving component, an adjustable finger hook for accommodating fingers of different sizes, and an attached stand for supporting the razor blade or other shaving component when the shaver is set down.

24 Claims, 3 Drawing Sheets

SHAVING APPARATUS WITH WHEEL

BACKGROUND OF THE INVENTION

1. Field of the Invention

The present invention pertains to shaving apparatuses, and particularly applies to shavers for shaving a user's head.

2. Description of the Related Art

A number of different shaving devices are available. The vast majority of such shaving devices primarily are designed for shaving a man's face or for shaving a woman's legs. In fact, a single design often has been used for both purposes. By far, the most common such multi-purpose designed utilizes a substantially straight handle that curves into a head portion, where the razor blade is mounted.

However, other designs also are available. For example, U.S. Pat. No. D426,918 ("Razor Having Finger Retainer," the '918 patent), U.S. Pat. No. 6,112,421 ("Multi-Use Razor," the '421 patent) and U.S. Pat. No. 6,018,877 ("Versatile Finger Retained Razor," the '877 patent), issued to the present inventor, describe and illustrate a different design that utilizes a shorter body and a hook, either open or closed (e.g., a ring), for engaging one's finger along the top surface of the shaver to assist in manipulating the shaver. The foregoing patents are incorporated herein by reference as though set forth herein in full.

The shaver designs disclosed in the foregoing patents have particular applicability to, and are particularly well-suited to, shaving one's head. However, the present inventor has discovered that additional improvements can be made to provide better results and to facilitate use of these and other shavers.

SUMMARY OF THE INVENTION

The present invention therefore addresses this need by providing a shaver that has one or more of the following elements: a wheel or other rolling device on the same side as the razor blade or other shaving component, an adjustable finger hook for accommodating fingers of different sizes, and an attached stand for supporting the razor blade or other shaving component when the shaver is set down.

Thus, in one aspect the invention is directed to a shaving apparatus that includes a main body having a razor blade (or other means for shaving the user's hair) attached to its bottom side. A wheel also is mounted on the bottom side of the main body in a manner such that the wheel is free to rotate.

In a further aspect, the invention is directed to a shaving apparatus that includes a main body having means for shaving the user's hair attached to its bottom side. A rolling means, for contacting the user's skin and then rolling as the shaving apparatus is moved across the user's skin, also is mounted on the bottom side of the main body.

By virtue of the foregoing arrangements, a shaver can be provided that often has improved comfort and friction reduction, as well as providing the user with better control in certain circumstances. The present invention is particularly well-suited to shavers having a finger hook (e.g., for holding and controlling the shaver using the middle three fingers) or other means for grasping the shaver along the top of the main body. However, the inventive features may be applied to other shaver designs as well.

In more particularized aspects, the shaver of the present invention uses a finger hook that is adjustable so as to accommodate different-sized fingers and/or to provide a secure fit. Certain embodiments of the invention utilize a wheel that is only permitted to rotate along a single axis (e.g., that is parallel to the razor blade and perpendicular to the direction in which the shaver typically is moved). Other embodiments utilize a wheel that may rotate in more than one dimension, such as in any desired direction.

Preferably, the shaver is configured such that when placed on a planar surface with its bottom side facing downwardly, only the razor blade (or other shaving means) and the wheel (or other rolling means) contact the planar surface. In addition, it is preferable to have the razor blade (or other shaving means) at one end of the shaver and the wheel (or other rolling means) at the other end of the shaver. However, a variety of different configurations may be utilized. For example, additional wheels may be utilized and/or the wheel (or any number of the wheels) may be disposed in close proximity to the razor blade (or other shaving means).

Optionally, the shaver may be provided with a stand that is attached to the main body and that supports the razor blade, such that when the shaving apparatus is placed on a surface, the stand prevents the razor blade from touching the surface. Preferably, such a stand pivots from a stored position for when the shaving apparatus is in use to an operational position for when the shaving apparatus is set down.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
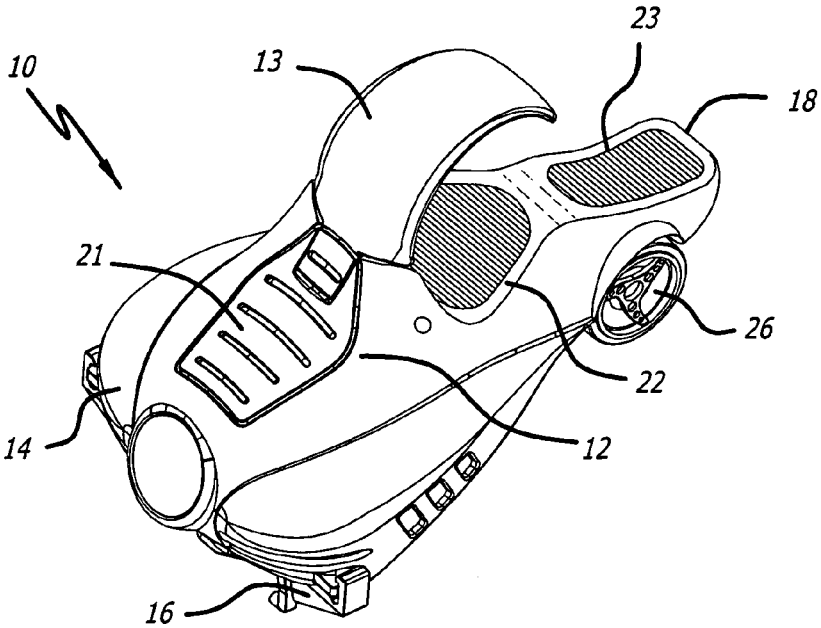
FIG. 1 is a top left-side perspective view of a shaver according to a representative embodiment of the present invention.
Figure 2:
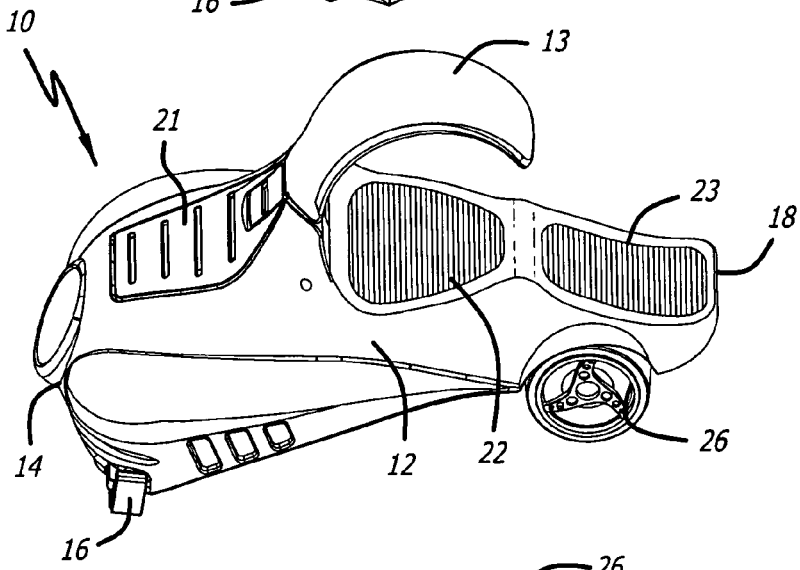
FIG. 2 is a top left-side perspective view of the shaver.

The attached figures illustrate a shaver 10 that is similar to the shavers disclosed in the '918, '421 and '877 patents, but that includes several additional features that are not disclosed in those patents. Like the shavers disclosed in those patents, shaver 10 utilizes a relatively short main body 12 (e.g., approximately 65–70 mm in length) that is also taller than most conventional shavers (e.g., approximately 40 mm in height, including finger hook 13). In the present embodiment, main body 12 is approximately triangular in shape, being wider at the front end 14 (e.g., approximately 40 mm wide) where the razor blade attachment clip 16 is mounted than at the rear end 18 (e.g., approximately 13 mm wide). While the illustrated and described configuration and dimensions are believed to be ideal for ease-of-use, shaver 10 instead may have any of a variety of other shapes and/or sizes.

As shown, razor blade attachment clip 16 preferably includes inward projections 17 for permitting a razor blade 19 to be pivotally attached to shaver 10. Also, clip 16 itself preferably is readily detachable and re-attachable to main body 12 of shaver 10. The razor blade 19 preferably is a conventional disposable razor blade cartridge that includes the blade itself and a supporting cartridge. Ordinarily, razor blade 19 is installed onto clip 16 so that its cutting edge 20 faces toward the front end 14 of shaver 10, meaning that shaving will occur when shaver 10 is moved along the skin in a cutting direction 24 such that the front end 14 is the leading end. However, it also is possible to install the razor blade 19 in the reverse manner so that the end 18 is the leading end.

Similar to the shavers disclosed in the '918, '421 and '877 patents, shaver 10 includes a finger hook 13 (which, as illustrated, is open in the preferred embodiment) and pads 21–23 for allowing manipulation of shaver 10 using the middle three fingers on the user's hand. More specifically, the user typically would place his or her index finger on pad 21, middle finger on pad 22 (underneath finger hook 13) and ring finger on pad 23. Alternatively, shaver 10 may be reversed so that the index finger rests on pad 23 and the ring finger rests on pad 21. In either event, shaver 10 is held and manipulated on the palm side of the user's hand. The use of finger hook 13 and pads 21–23 in this manner frequently can allow for manipulation of a shaver 10 in a way that is more natural and particularly well-suited for shaving one's head. With the use of a disposable razor blade 16 detachably mounted to the bottom of shaver 10, the user can shave his or her head using the same motion that one ordinarily would used to smooth one's hair.

Pads 21–23 may be attached to the main body 12 of shaver 10 in any of a variety of different ways. For example, they may be snap-fitted or glued onto main body 12. Alternatively, pads 21–23 may even be integrally formed as a part of main body 12, e.g., by using a different texture for the surfaces of main body 12 that are to be designated as the pad areas.

Inclusion of a Wheel

Figure 6:
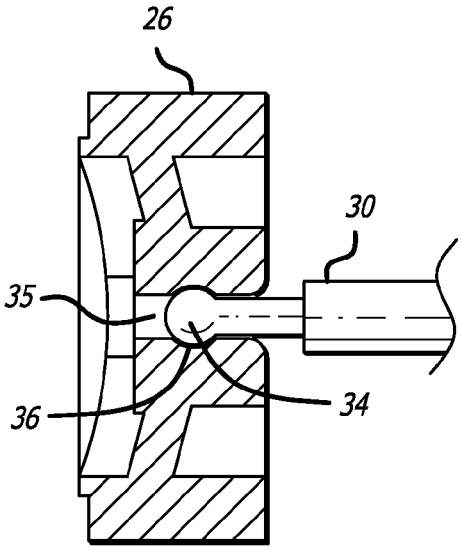
FIG. 6 is a close-up cross-sectional view of the wheel axis inserted into the wheel.

One of the additional features, not disclosed in the '918, '421 and '877 patents, is the inclusion of a wheel 26 on the rear end 18 of shaver 10. In the preferred embodiment of the invention, wheel 26 actually is implemented as two separate wheels 26 which are attached to the main body 12 using an axle 30 that passes through at least one guiding hole 32 in the bottom portion of rear end 18 and that attaches to wheels 26 each end. As shown in FIG. 6, the preferred configuration for attaching axle 30 to wheels 26 is to use a mating male-and-female snap-fit construction. In particular, in the current embodiment of the invention, axle 30 has a flexible but resilient ball 34 at each end and each wheels 26 has a channel 35 that has a fixed width other than a wider ball-shaped portion 36 within the interior of wheel 26. As a result, when axle 30 is pressed into channel 35 ball 34 initially is deformed and then returns to its normal shape once it enters portion 36, thereby locking wheel 26 onto axle 30. It should be noted that the material of wheel 26 surrounding channel 35 also (or instead) may be flexible but resilient, in order to facilitate the attachment to axle 30. In this embodiment, the wheels 26 can be easily removed (e.g., by pulling with sufficient force), thereby permitting wheels 26 to be interchanged with other replacement wheels (e.g., having different designs). Various other temporary attachment mechanisms may also be utilized.

In other embodiments, more permanent techniques may be used for securing one or more wheels 26 to an axle. For example, each wheel 26 may be provided with a hole that extends all the way through the center of such wheel 26. Then, the axle is inserted through such hole and the end of the axle is permanently deformed so that it will be wider than the hole through the wheel 26.

Still further, a wheel 26 may be attached to the main body 12 of a shaver 10 in any of a variety of different ways. For example, the use of an axle in the present embodiment restricts motion of the wheel 26 to rotation through a single axis (which is parallel to the cutting edge of razor blade 19 in the present embodiment). As a result, when utilized in a shaver this configuration often will only permit back and forth motion in a single dimension. In many cases, such a restriction may be desirable in that it may help to prevent accidental lateral motion which may result in nicking or cutting.

On the other hand, in other embodiments it may be more desirable to utilize a different wheel configuration that facilitates movement in more than one dimension. Such a feature might be desirable, for example, where a curved razor blade or a blade other than the standard straight safety razor blade is to be utilized. In this case, a ball-and-socket configuration may be utilized in which wheel 26, rather than being cylindrically shaped, as in the embodiment described above, instead is spherically shaped and is fitted into a ball-shaped socket joint (e.g., formed from a resilient flexible material, thereby allowing ball-shaped wheel 26 to snap in).

In either event, the provision of a wheel 26 on the rear end 18 of a shaver 10 often can facilitate the movement of shaver 10 during the shaving process, frequently resulting in a smoother shaving experience. In the absence of such a wheel 26, the rear end 18 of shaver 10 may encounter stubble or other obstacles that interfere with such shaving and/or may unintentionally scrape off shaving lotion before the blade 16 has a chance to reach that portion of the user's skin.

In the preferred embodiment, shaver 10 is configured such that when it is resting on a planar surface only the wheel 26 and the razor blade 19 will be making contact with the surface. As described in more detail below, in certain embodiments of the invention the razor blade 19 can be prevented from touching the surface through the use of a stand.

It should be noted that a wheel 26 can be utilized with similar benefits in other shaver designs, irrespective of whether the shaver is primarily designed for use on the head or on any other part of the body. Still further, although the wheel 26 is attached to the rear end 18 in the present embodiment of the invention, a wheel 26 may instead (or in addition) be disposed close to the razor blade 16 or other shaving element (e.g., a rotary cutting blade in an electric shaver). Lastly, even in the embodiment described above, the position of the wheel 26 may be considered the front end of the shaver 10 by reversing the installation of the razor blade 16 so that the wheel 26 is at the leading (or front) end of shaver 10 and razor blade 16 trails behind at the rear end.

Each wheel 26 may be formed from rubber, synthetic rubber, plastic, metal or any other material or combination of materials. The specific material(s) from which the wheel(s) 26 are fabricated are chosen based upon known trade-offs in material properties.

Pivoting Stand

An additional feature of the present invention is the inclusion of a pivoting stand 50. As shown, in the present embodiment stand 50 is primarily U-shaped, having small outward projections 52 at the upper points of the "U". Projections 52 are inserted into mating holes 54 in the main body 12 of shaver 10. Preferably, stand 50 is flexible and resilient, so that it can be than slightly inwardly so that projections 52 align with holes 54 and then released to insert projections 52 into holes 54, thereby attaching stand 50 to main body 12, and allowing stand 50 to pivot at points 52.

Figure 3:
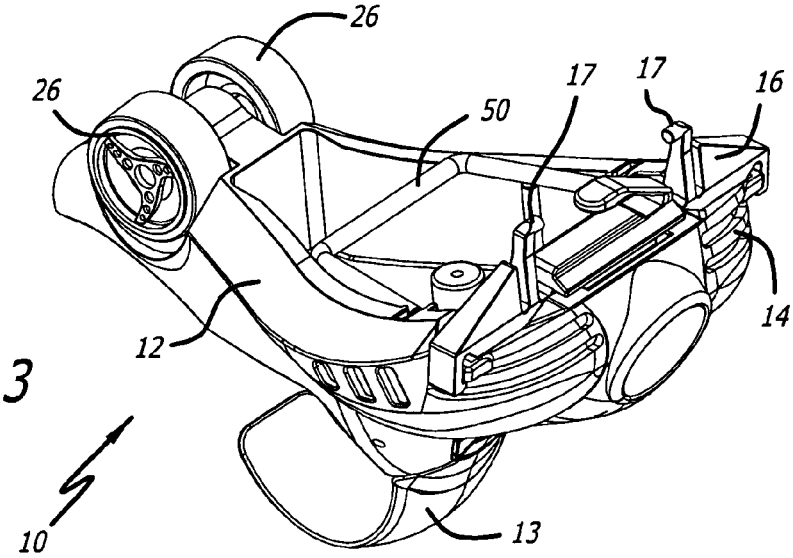
FIG. 3 is a bottom left-side perspective view of the shaver.
Figure 5:
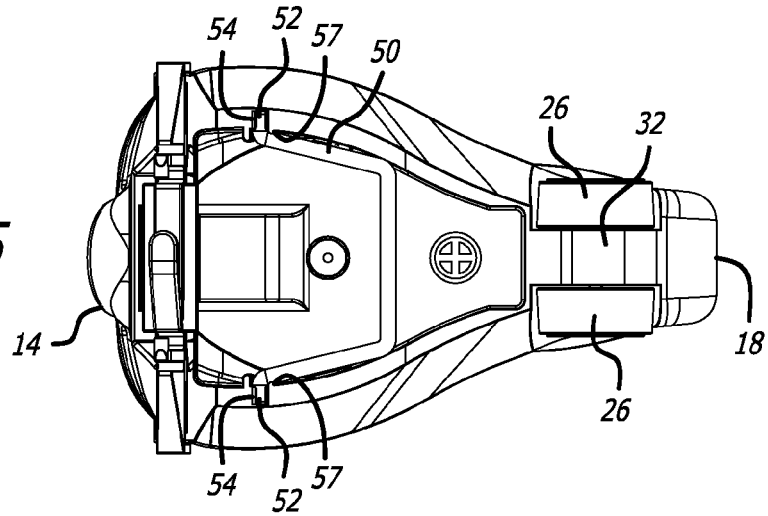
FIG. 5 is a bottom plan view of the shaver.

In the preferred embodiments, stand 50 remains in the "up" position (as shown in FIGS. 3 and 5) in normal use. This can be accomplished, for example, by providing main body 12 of shaver 10 with a locking mechanism (e.g., a pair of simple clips 57) or by providing sufficient friction in the mating of projections 52 with holes 54 so that stand 50 can only be pivoted by providing external force.

Figure 4:
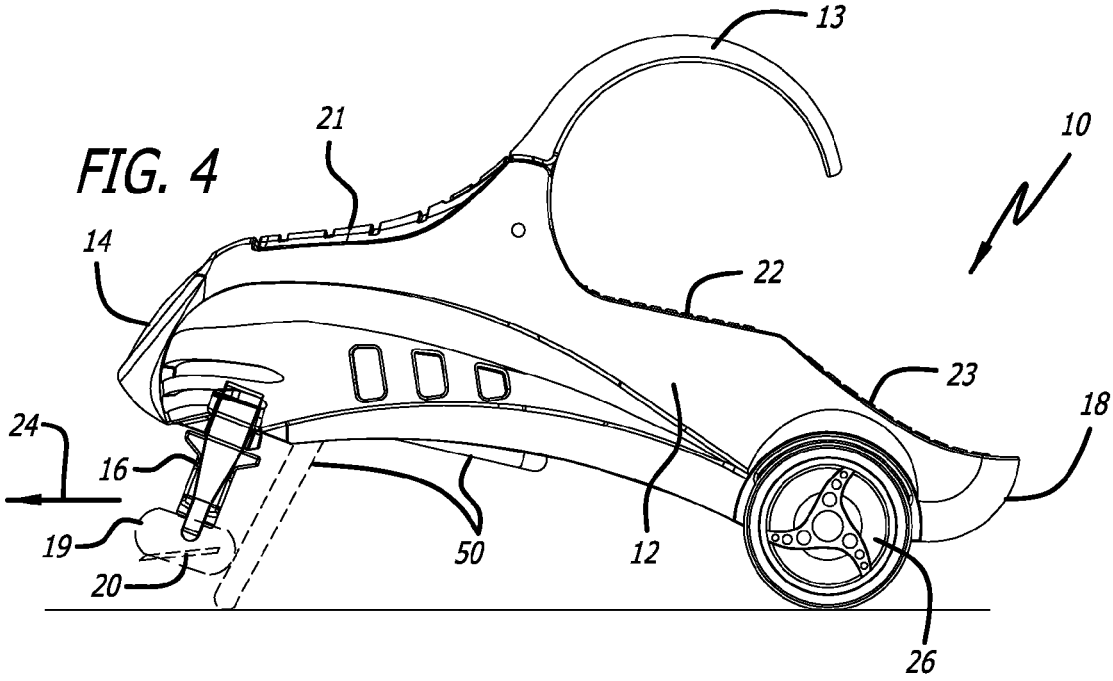
FIG. 4 is a left-side elevational view of the shaver.

In any event, when the shaver 10 is not in use, stand 50 can be pivoted to the downward position (as illustrated in FIG. 4), thereby lifting the razor blade 16 off of the surface on which shaver 10 is placed. Preferably, stand 50 is rotated into a position past vertical (also as shown in FIG. 4) so that gravity alone will keep stand 50 in the desired orientation when shaver 10 is left in this position, i.e., obviating the need to use any separate locking mechanism for this position.

The stand 50 may be made from metal, plastic or any other material. However, as noted above, stand 50 preferably is made of a resilient material.

Adjustable Finger Hook

A further feature of shaver 10 according to the preferred embodiments of the invention is the inclusion of an adjustable finger hook 13. More specifically, finger hook 13 preferably is configured so as to be capable of opening and closing, thereby providing the ability to accommodate fingers of different sizes and/or to allow a user to insert his or her finger while finger hook 13 is more fully open and then to close finger hook 13 to obtain a better fit for operational use of shaver 10.

Figure 7:
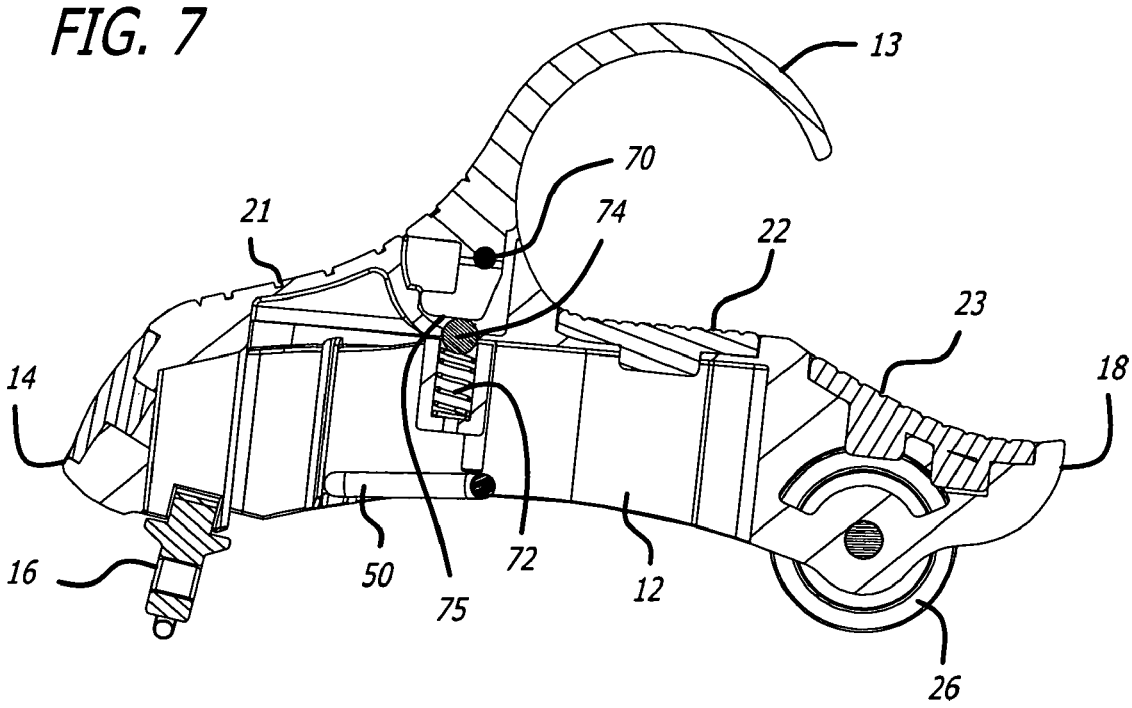
FIG. 7 is a left-side cross-sectional view of the shaver, with the finger hook in the fully closed position.
Figure 8:
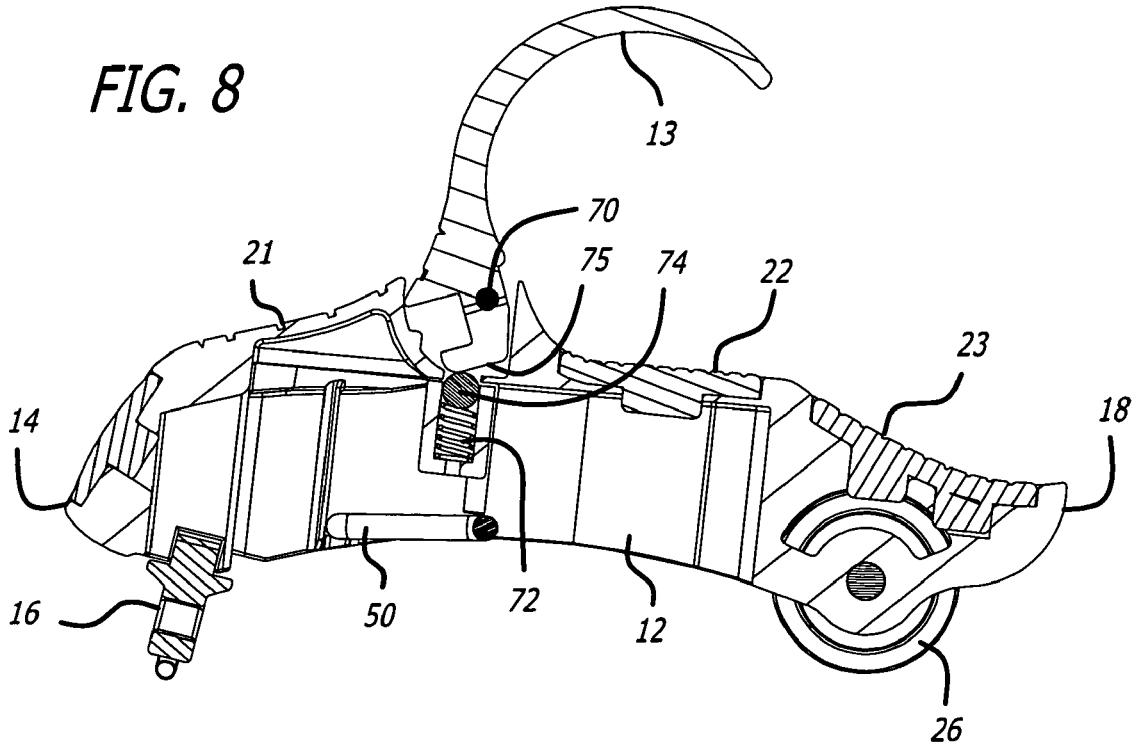
FIG. 8 is a left side cross-sectional view of the shaver, with the finger hook close to the fully open position.

One particular embodiment of such an adjustment mechanism is illustrated in FIGS. 7 and 8. As shown, finger hook 13 pivotally attaches to the main body 12 through the use of a pivoting axle 70 that attaches to main body 12 at each of it ends and that passes through a corresponding hole in finger hook 13. As a result, finger hook 13 is capable of pivoting toward the front end 14 of main body 12 (i.e., toward a more open position) or toward the rear end 18 (i.e., toward a more closed position).

In the preferred embodiment, finger hook 13 is spring-biased toward the closed position. This is achieved in the present embodiment as follows. A compression spring 72 is disposed within a cavity of the main body 12 of shaver 10 and supports a rotating element 74. The bottom surface 75 of finger hook 13 engages rotating element 74 as hook 13 is pivoted from the open to the closed position and vice versa. In addition, bottom surface 75 is shaped so as to press downwardly on rotating element 74 as hook 13 is rotated toward the open position. In the present embodiment, this is accomplished by using a straight bottom surface 75 and locating the compression spring 72 and corresponding rotating element 74 in front of the pivoting axis 70. However, any other configuration that accomplishes the same result may instead be used. In any event, the downward pressure causes spring 72 to compress, thereby providing resistance against forward rotation of hook 13.

In the present embodiment, rotating element 74 is spherical. However, other configurations also are contemplated. For instance, rotating element 74 may be implemented as a horizontal bar having a circular cross-section (in which case it might be desirable to use more than one spring 72).

While the present embodiment uses a compression spring, other configurations may use leaf springs or similar arrangements. Also, rather than having smooth motion from the closed position to the open position, alternate embodiments may include one or more notches on the bottom surface 75, thereby providing a number of locked positions.

Additional Considerations.

In the above embodiments, the razor blade 19 and the wheel 26 are on the bottom side of the shaver 10. Generally speaking, what this means is that razor blade 19 and wheel 26 will contact the user's skin simultaneously when shaver 10 is in use. Preferably, these are the only two components of shaver 10 that in fact contact the user's skin during use. If this is the case, it generally will be easier to obtain the above-referenced desired properties, with the razor blade 19 (or other shaving means) shaving the user's head and the wheel 26 providing additional stability without undue drag.

Shaver 10 preferably is fabricated entirely or almost entirely from steel or another metal. However, it instead may be fabricated from plastic or any other type of material.

While a specific configuration is described above and illustrated in the drawings for shaver 10, it should be understood that the novel features described above may be applied to any of a variety of different shaver configurations, including any conventional shaver or any of the configurations disclosed in the '918, '421 and '877 patents.

Preferably, shaver 10 is provided with one or more removable decals, permitting the user to customize the shaver 10 as he or she desires. For example, the front end 14 may be provided with a space (e.g., a smooth surface) for such removable decals.

In the embodiments described above, a finger hook 13 is used for holding and manipulating the shaver 10. However, other configurations may be used for this purpose. For example, hook 13 may be replaced with a handle, a tab that may be grasped between the thumb and index finger, or any similar device.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality may be ascribed to a particular module or component. However, unless any particular functionality is described above as being critical to the referenced module or component, functionality may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shaving apparatus, comprising:

(a) a main body having a top side and a bottom side;

(b) a razor blade attached to the bottom side of the main body; and (c) a wheel, mechanically decoupled from the razor blade and mounted on the bottom side of the main body in a manner such that the wheel is free to rotate, wherein said shaving apparatus is a shaver, such that shaving occurs when said shaving apparatus is moved along a user's skin, and wherein the razor blade is at a first end of the main body and the wheel is at a second end of the main body, with the second end being opposite the first end.

2. A shaving apparatus according to claim 1, wherein the razor blade is pivotally mounted on the bottom side of the main body.

3. A shaving apparatus according to claim 1, wherein the main body has disposed on its top side grasping means for facilitating grasping of the main body.

4. A shaving apparatus according to claim 3, wherein the grasping means comprises a hook, through which a user's finger can be inserted.

5. A shaving apparatus according to claim 3, wherein the grasping means is adjustable to fit different-sized fingers.

6. A shaving apparatus according to claim 3, wherein the grasping means is configured to permit the main body to be held and manipulated for shaving a user's head by using only the user's three middle fingers.

7. A shaving apparatus according to claim 1, wherein the razor blade has a cutting edge, and wherein the wheel has an axis of rotation that is parallel to said cutting edge.

8. A shaving apparatus according to claim 7, wherein the wheel can only rotate around said axis of rotation.

9. A shaving apparatus according to claim 1, wherein the razor blade has a cutting direction, and wherein the wheel is behind the razor blade with respect to said cutting direction.

10. A shaving apparatus according to claim 1, wherein the main body is configured such that when the main body is placed on a planar surface with its bottom side facing downwardly, only the razor blade and the wheel contact the planar surface.

11. A shaving apparatus according to claim 1, wherein the razor blade is mounted within a supporting cartridge that is removably attached to the main body.

12. A shaving apparatus according to claim 1, further comprising a stand attached to the main body that supports the razor blade, wherein when the shaving apparatus is placed on a surface, the stand prevents the razor blade from touching the surface.

13. A shaving apparatus according to claim 12, wherein the stand pivots from a stored position for when the shaving apparatus is in use to an operational position for when the shaving apparatus is set down.

14. A shaving apparatus, comprising:

(a) a main body a having a top side and a bottom side;

(b) shaving means, mounted on the bottom side of the main body, for shaving a user's hair; and (c) rolling means, mechanically decoupled from the shaving means and mounted on the bottom side of the main body, for contacting the user's skin and then rolling as the shaving apparatus is moved across the user's skin, wherein said shaving apparatus is a shaver, such that shaving occurs when said shaving apparatus is moved along a user's skin, and wherein the razor blade is at a first end of the main body and the wheel is at a second end of the main body, with the second end being opposite the first end.

15. A shaving apparatus according to claim 14, wherein the shaving means comprises a razor blade.

16. A shaving apparatus according to claim 15, wherein the razor blade has a cutting edge, and wherein the rolling means has an axis of rotation that is parallel to said cutting edge.

17. A shaving apparatus according to claim 16, wherein the rolling means can only rotate around said axis of rotation.

18. A shaving apparatus according to claim 14, wherein the main body has disposed on its top side grasping means for facilitating grasping of the main body.

19. A shaving apparatus according to claim 18, wherein the grasping means comprises a hook, through which a user's finger can be inserted.

20. A shaving apparatus according to claim 18, wherein the grasping means is adjustable to fit different-sized fingers.

21. A shaving apparatus according to claim 18, wherein the grasping means is configured to permit the main body to be held and manipulated for shaving a user's head by using only the user's three middle fingers.

22. A shaving apparatus according to claim 14, wherein the main body is configured such that when the main body is placed on a planar surface with its bottom side facing downwardly, only the shaving means and the rolling means make contact with the planar surface.

23. A shaving apparatus according to claim 14, further comprising a stand attached to the main body that supports the shaving means, wherein when the shaving apparatus is placed on a surface, the stand prevents the shaving means from touching the surface.

24. A shaving apparatus according to claim 23, wherein the stand pivots from a stored position for when the shaving apparatus is in use to an operational position for when the shaving apparatus is set down.

* * * * *